US007017285B2

(12) United States Patent
Lakic

(10) Patent No.: US 7,017,285 B2
(45) Date of Patent: Mar. 28, 2006

(54) INFLATABLE LINING FOR FOOTWEAR WITH PROTECTIVE AND COMFORTABLE COATINGS OR SURROUNDS

(76) Inventor: Nikola Lakic, 45-191 Elm St., Indio, CA (US) 92201

( * ) Notice: Subject to any disclaimer, the term of this patent is extended or adjusted under 35 U.S.C. 154(b) by 0 days.

(21) Appl. No.: 10/928,051

(22) Filed: Aug. 27, 2004

(65) Prior Publication Data

US 2005/0022423 A1 Feb. 3, 2005

Related U.S. Application Data

(60) Continuation of application No. 10/326,247, filed on Dec. 20, 2002, now abandoned, which is a division of application No. 09/658,164, filed on Sep. 8, 2000, now Pat. No. 6,510,624.

(60) Provisional application No. 60/153,256, filed on Sep. 10, 1999.

(51) Int. Cl.
*A43B 13/20* (2006.01)

(52) U.S. Cl. ..... 36/29; 36/43; 36/44; 36/88

(58) Field of Classification Search ..... 36/28, 36/29, 3 R, 3 B, 43, 44, 88
See application file for complete search history.

(56) References Cited

U.S. PATENT DOCUMENTS

| | | | |
|---|---|---|---|
| 4,219,945 | A | 9/1980 | Rudy |
| 4,271,606 | A | 6/1981 | Rudy |
| 4,999,931 | A | 3/1991 | Vermeulen |
| 5,625,964 | A | 5/1997 | Lyden |
| 5,753,061 | A | 5/1998 | Rudy |
| 5,832,630 | A | 11/1998 | Potter |
| 5,846,063 | A | 12/1998 | Lakic |

*Primary Examiner*—M. D. Patterson
(74) *Attorney, Agent, or Firm*—Schmeiser, Olsen & Watts LLP

(57) ABSTRACT

The invention is an inflatable inner sole for footwear which has a flexible, inflatable enclosure with an inflation system that preferably includes an on-board air pump and a pressure relief valve. In this invention the inner sole has a sheet and/or foam cover or surround on the flexible enclosure for enhanced comfort. Useful sheet covers can be plastic, including rubber, films in solid or foamed state, or fabric which are applied against the upper, wearing surface of the inflatable enclosures. The covers can be bonded only to the edges of the inflatable enclosures to permit relative movement between the covers and enclosures, or can be bonded to the top surface of the enclosures, or formed as surrounds which encapsulate the inflatable enclosures.

20 Claims, 18 Drawing Sheets

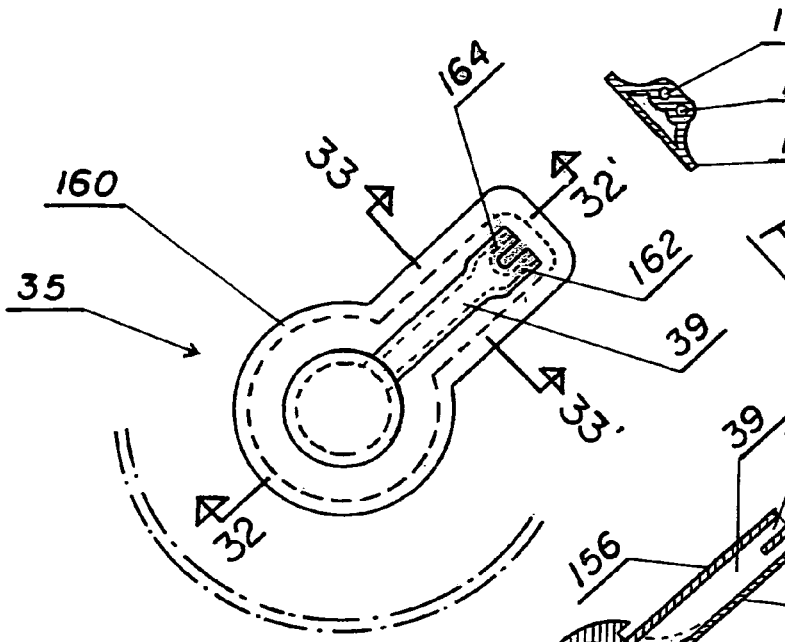
FIG. 31
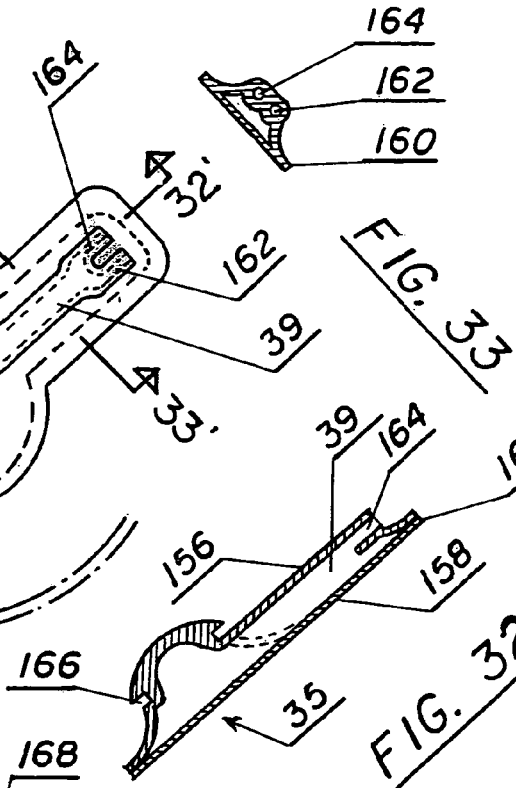
FIG. 33
FIG. 32
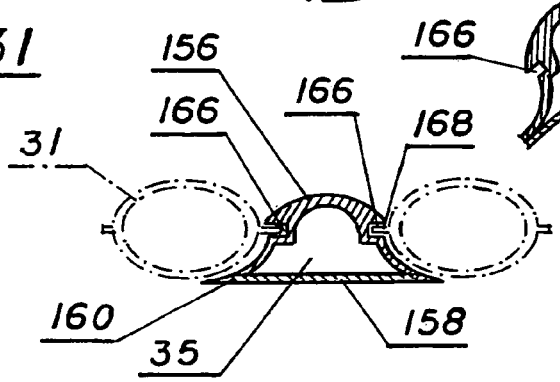
FIG. 34
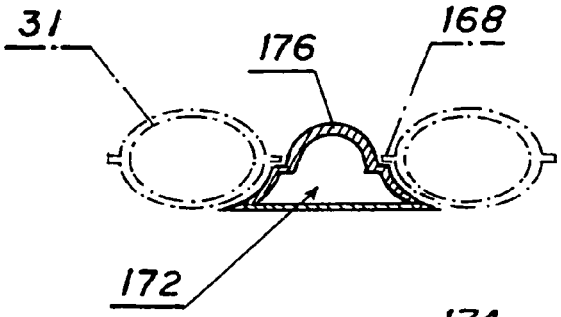
FIG. 35
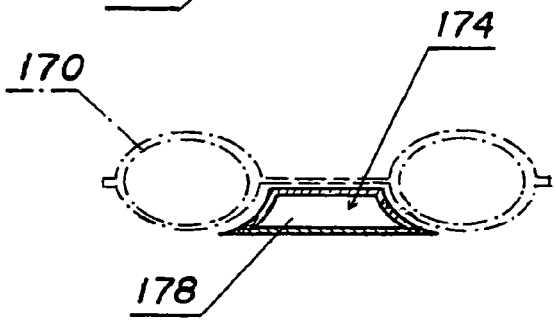
FIG. 36

INFLATABLE LINING FOR FOOTWEAR WITH PROTECTIVE AND COMFORTABLE COATINGS OR SURROUNDS

This application is a continuation of U.S. patent application Ser. No. 10/326,247, filed on Dec. 20, 2002, entitled "INFLATABLE LINING FOR FOOTWEAR WITH PROTECTIVE AND COMFORTABLE COATINGS OR SURROUNDS", now abandoned which is a divisional of U.S. patent application Ser. No. 09/658,164, filed on Sep. 8, 2000, and issued as U.S. Pat. No. 6,510,624, entitled "INFLATABLE LINING FOR FOOTWEAR WITH PROTECTIVE AND COMFORTABLE COATINGS OR SURROUNDS", which is entitled to the benefit of U.S. Provisional Application Ser. No. 60/153,256, filed on Sep. 10, 1999. The disclosures of these related applications are incorporated herein by this reference.

BACKGROUND OF THE INVENTION

1. Field of the Invention

This invention relates to an inflatable lining for footwear, particularly to an inflatable inner sole with protective and comfortable coatings and surrounds and method for its manufacture.

2. Brief Statement of the Prior Art

Inner soles have been provided for shoes and boots which are formed of a compressible, elastic material such as cellular plastic foams, foam rubber, etc. These inner soles have provided only limited shock absorbency, resulting in little no significant improvement in wearer comfort.

Some prior investigators have provided inner soles with inflated cushions at either the toe and heel areas, and some have provide cushions at both areas with circulation between the two cushions. The cushions have been provided with mechanisms to circulate air and ventilate the shoe or boot during walking activities. Examples of these are: U.K. Patents 2,189,679 and 357,391; U.S. Pat. Nos. 3,180,039, 2,716,293, 1,213,941 and German Patent 3,144,207.

Sport socks are also available for hikers and runners which have a double layer of fabric on the undersurface of the sock in an attempt to prevent blisters.

In some foot apparel, notably in ski boots, an outer shell is molded from plastic and is lined with an inner shoe. Adjustment has been made to the tightness of the outer shell and air bags have been provided across the instep region of the shoe, and elsewhere, and have been provided with an air pump to pressure the air bags, thus forcing the foot against the sole and creating a snugness of the fit of the ski boot. U.S. Pat. No. 4,730,403 and German Patent 2,321,817 are representative of these ski boots.

A water-filled inner sole for shoes has recently been marketed under the trade name "Walk On Water". While this is an attempt to increase wearer comfort, water is heavy, non-compressible and the inner sole cannot be adjusted for firmness, and cannot provide shock absorbency. Additionally, water is unsuited for use in freezing climates. Also, a leak will wet the inside of the bootwear, and this inner is not breathable.

Another recently marketed innovation is that disclosed in U.S. Pat. Nos. 4,183,156; 4,340,626 and 4,817,304 in which an inflatable inner sole or sole insert is permanently inflated with halogenated hydrocarbon gases. Since it is impossible to preclude diffusion of gases through the plastic, the inflatable insert or inner sole is acknowledged to experience a rapid increase in pressure shortly after manufacture, followed by a slowly declining pressure, thus failing to provide a stable condition. The pressure of the inflatable member also cannot be adjusted by the wearer for varying conditions of use and comfort.

None of the aforementioned prior devices provides a simple, inexpensive solution to comfortable wear and walking in a shoe or boot. The foam inner soles have only a limited value and limited shock absorbency. The remainder of the prior devices, including the pressurization system for ski boots are relatively complex and costly and are often too bulky and cumbersome. Consequently, these devices are not readily acceptable for everyday activities.

In my prior patent (U.S. Pat. No. 5,846,063) I disclose and claim inflatable linings with an on board inflation pump and relief valve which is readily adaptable to mass manufacturing techniques. A preferred application of the inflatable enclosure is that of an inflatable inner sole of footwear.

OBJECTIVES OF THE INVENTION

It is an objective of this invention to provide a light weight, shock-absorbing inflatable lining which enhances the fit, stability and comfort of footwear.

It is also an objective of this invention to provide the aforementioned inflatable lining with an on-board air pump and relief valve to permit the wearer to adjust the lining from firm to soft support, as desired for the wearer's weight and or activity.

It is an additional objection of this invention to provide an inflatable lining as an inner sole for footwear such as shoes, boots and sandals, having an arch pillow and a contour conforming to the wearer's foot, which preferably will massage the wearer's foot.

It is likewise an objection of this invention to provide an inflatable lining as an inner sole for orthopedic footwear to treat and prevent foot disorders.

It is a further objective of this invention to provide an inflatable lining with a surface which will prevent blister formation.

It is a further objective of this invention to provide the aforementioned inflatable linings with a fabric and/or foam covering for comfort enhancement.

It is also an objective of this invention to provide a simple method for manufacture of the inflatable lining.

Other and related objectives will be apparent from the following description of the invention.

BRIEF DESCRIPTION OF THE INVENTION

This invention comprises an inflatable lining for footwear which has sheet and/or foam coatings or surrounds for enhanced comfort and a method for its manufacture. Useful sheet coatings can be plastic films or fabric and, when used, are applied against the wearing surface of the lining. Plastic foam, when used, alone or in combination with sheet coatings, can be applied to either surface of the lining, preferably as a surround which encapsulates the inflated lining. The inflatable linings are preferably those described in my prior patent (U.S. Pat. No. 5,846,063) which include an on-board air pump and relief valve.

BRIEF DESCRIPTION OF THE DRAWINGS

The invention will be described with reference to the figures of which:

FIGS. 31–36 are plan and sectional views of the heel air pump used in the inner sole shown in FIG. 26;

DETAILED DESCRIPTION OF THE INVENTION

Figure 1:
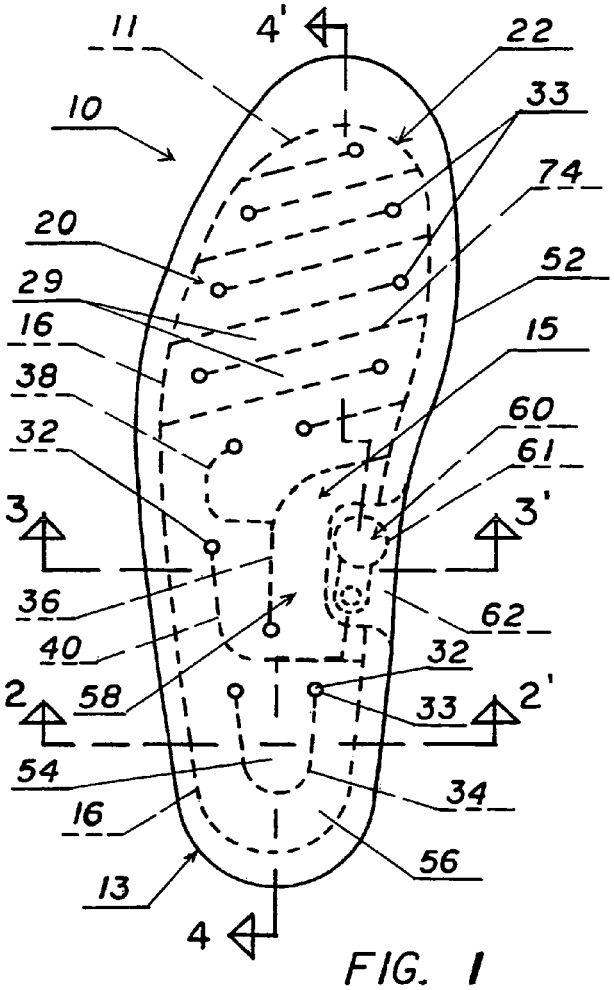
FIG. 1 is a plan view of an inflatable inner sole encapsulated in an elastomeric material with an on-board air pump and adjustable relief valve.
Figure 4:
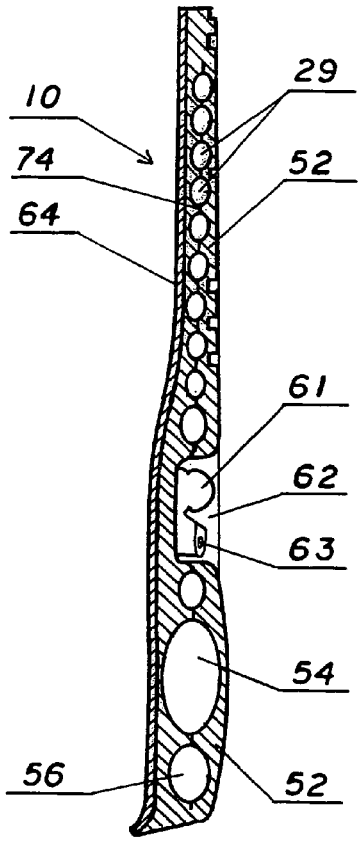
FIG. 4 is a cross sectional view along line 4–4' of the inner sole of FIG. 1.
Figure 3:
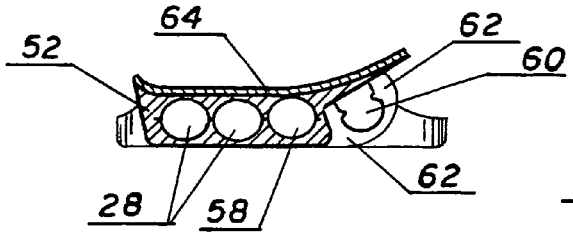
FIG. 3 is a cross sectional view along line 3–3' of the inner sole of FIG. 1.
Figure 2:
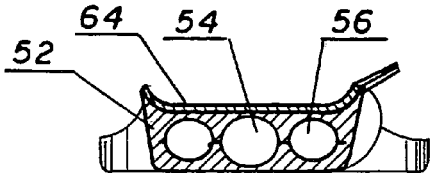
FIG. 2 is a cross sectional view along line 2–2' of the inner sole of FIG. 1.
Figure 5:
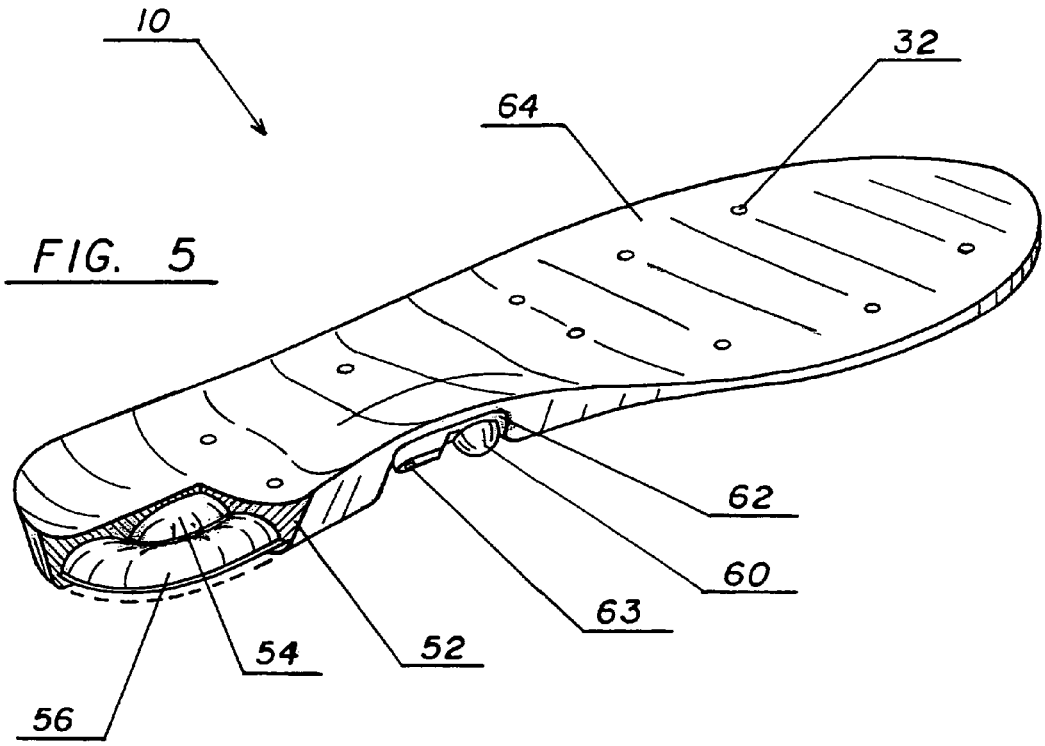
FIG. 5 is a perspective view of the inflatable inner sole of FIG. 1.
Figure 6:
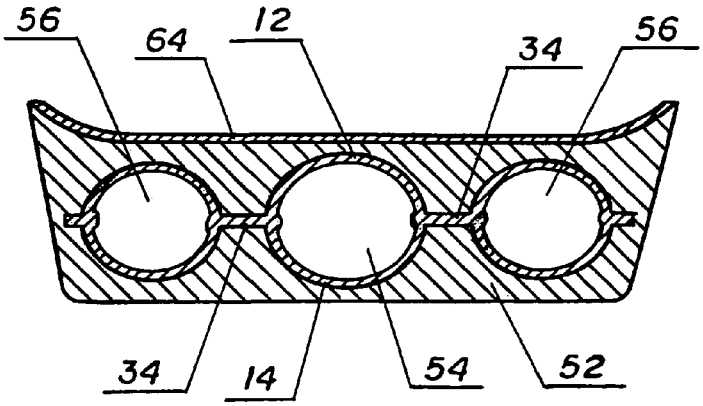
FIG. 6 is an enlarged sectional view of a portion of FIG. 2 to illustrate the construction of the inflatable lining of the inner sole.
Figure 7:
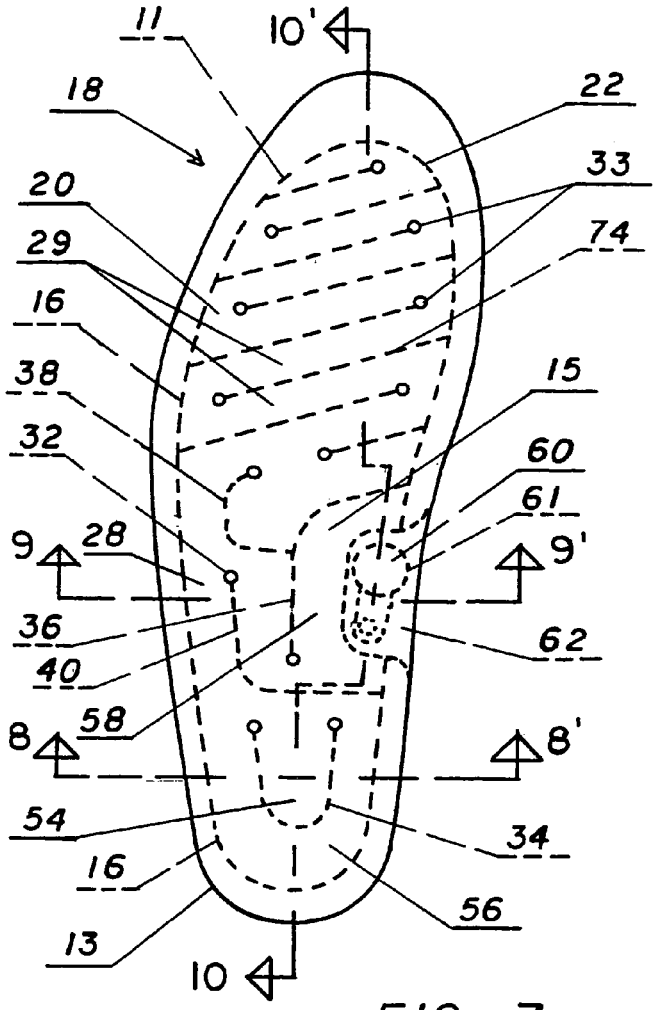
FIG. 7 is a plan view of an alternative inflatable inner sole having an upper elastomeric coating with an on-board air pump and adjustable relief valve.
Figure 10:
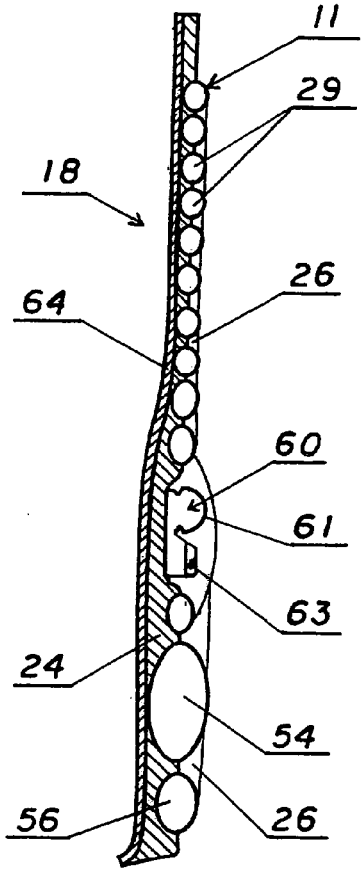
FIG. 10 is a cross sectional view along line 10–10' of the inner sole of FIG. 7.
Figure 9:
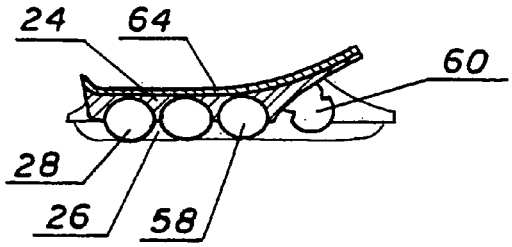
FIG. 9 is a cross sectional view along line 9–9' of the inner sole of FIG. 7.
Figure 8:
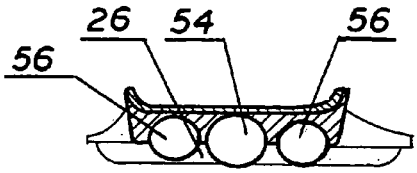
FIG. 8 is a cross sectional view along line 8–8' of the inner sole of FIG. 7.

Referring now to FIGS. 1–5, the invention as applied to an inflatable inner sole will be described. The inflatable inner sole 10 is shown in plan view in FIG. 1, in sectional views in FIGS. 2–4, in perspective, partial sectional view in FIG. 5 and in an enlarged sectional view in FIG. 6. The inflatable inner sole 10 which has an inflatable enclosure 11 that extends across the entire sole including the heel area 13, the arch or instep area 15, the toe area 22 and metatarsal area 20. The inflatable enclosure 11 is formed by a first sheet 12 and a coextensive second sheet 14 of substantially the same shape and size. These sheets can be best seen in the enlarged sectional view, FIG. 6. The first and second sheets 12 and 14 are bonded together in a continuous peripheral seam 16 that extends about the heel area 13 and the instep area 15 of the inner sole 10. The seam is sufficiently wide to form an annular flange 17 which is die cut to approximately the correct size and shape for the particular inner sole. The flange 17 is oversized, however, to permit the user to trim the inner sole 10 to the exact shape and size of the wearer's footwear.

The first and second sheets 12 and 14 are preferably plastic and most preferably are thermoplastic, so that conventional heat sealing can be used for forming the seams. The most preferred thermoplastic material is polyurethane, however, other suitable materials include ethylene, and ethylene vinyl acetate copolymers, polyethylene, polypropylene, polyvinyl chloride, etc. Natural or synthetic rubber can also be used.

The first sheet 12 and second sheet 14 are also bonded together with a plurality of discontinuous seams 34, 36 and 38 and 40 which form tubular, interconnecting passageways 56 through the heel area 13 and passageways 28 through the instep area 15 of the inner sole 10. The inflatable enclosure 11 also has a plurality of discontinuous, transverse seams 74 in the metatarsal area 20 and toe area 22 to impart flexibility to the inner sole 10 and to form interconnecting passageways 29 which extend across these areas to permit the wearer to control the firmness and support of the inner sole simply by controlling the inflation pressure within the inflatable enclosure 11.

The spacing between adjacent seams controls the size (diameter) of the passageways 28 and 29. If desired, some areas of the inflatable enclosure 11 can be unseamed to form air pillows. The size and spacing of the interconnecting passageways and pillows can easily be varied during manufacture to adapt the inner sole to the particular shoe. Thus, the pillows and passageways in the arch area can be small in size to fit conventional shoes with integral arch supports or large in size for use with shoes having flat or near flat soles, to provide an arch support. In either case, the firmness of the inner sole 10 can be regulated by adjustment of the air pressure within the inflatable enclosure 11.

Preferably, the seams have a plurality of through perforations or apertures 32 which extend entirely thorough the first and second sheets 12 and 14 and are entirely surrounded by a seam 30. The spacing, size and number of these discontinuous seams can be varied greatly, as desired, to provide the maximum comfort and convenience to the wearer of a shoe fitted with the inflatable inner sole 10.

The C-shaped heel seam 34 forms a heel pillow 54 and a heel peripheral tubular passageway 56. There is a small C-shaped arch pillow 58 which is formed by seams 16, 36 and 40 and which forms a medial recess 62 that receives the inflation assembly 60 which includes an air pump 61 and relief valve 63. The inflatable inner sole 10 is intended for use as a replacement insert for shoes which have some arch support. Therefore this embodiment 10 has a small arch pillow 58, sufficient to encircle the pump and relief valve assembly 60.

The inflatable enclosure 11 is encapsulated in a matrix 52 formed of an elastomeric material such as synthetic rubber, e.g., polyurethane, or a foamed compressible plastic such as polyurethane foam, polyethylene foam, etc. The step of encapsulating the inflatable enclosure 11 is performed by placing the inflated enclosure 11 in a mold and injecting the elastomer or foaming resin. One or more apertures 33 can be provided which extend through the matrix 52. The compressibility of the foam or elastomer can be selected to provide a suitably soft and comfortable feel to the inner sole 10 and the firmness and shock absorbency of the inner sole 10 can thus be controlled by the inflation pressure which is maintained in the inflatable enclosure 11.

The upper or wear surface of the inner sole 10 is covered with an outer layer 64 of fabric. The fabric may be Nylon such as widely used in inflatables produced by Mann Industries, Inc., of Framingham, Mass., or material produced by Faytex Corp., Weymouth, Mass., like DRI-LEX® LINING, HYDROFIL® Nylon from Allied Signal. The moisture absorbing qualities of the HYDROFIL Nylon draws moisture away from the skin keeping the user dry, cool and comfortable.

In reference to other illustrations of the invention, the components of this inner sole which are the same as those of previously described inner sole 10 are identified with the same numbers as used in FIGS. 1–6.

FIGS. 7–10 illustrate an alternative inflatable inner sole 18 which has an upper layer 24 of elastomer matrix. This embodiment is quite similar to that shown in FIGS. 1–6, however, the inflatable enclosure 11 is not encapsulated within a matrix of elastomer or foam. Instead, the layer 24 of elastomer is formed on the upper surface of the first sheet of the inflatable enclosure 11 and the under surface of the inflatable enclosure 11 rests on the inside wall of the sole of the footwear, forming open channels 26 beneath the enclosure 11.

Figure 11:
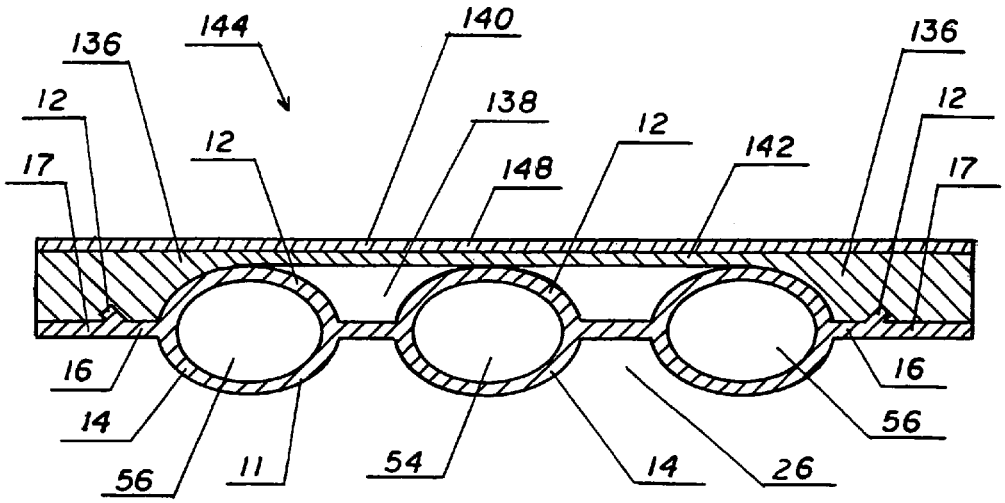
FIG. 11 is an enlarged cross sectional view of an alternative upper coating.

FIG. 11 is a cross sectional view of an alternative inner sole 144 which is particularly useful in sport shoes such as cross country shoes for runners and hikers, as the construction permits movement between the inflatable enclosure 11 and the upper cover 140. In this construction, the inflatable enclosure 11 is surrounded with a peripheral upper rim 136 of elastomer or foam, leaving the areas between the inflated passageways such as connecting passageway 56 and pillow 54 void, which minimizes the bulk and weight of the inner sole 144 and provides an air chamber 138 above the inflatable enclosure 11. A fabric 148 is bonded to an underlayer 142 of thermoplastic, such as polyurethane and the underlayer 142 is bonded to the peripheral upper rim 136, leaving the field of the surface of the inflatable enclosure 11 unbonded to the cover 140, thereby permitting relative movement between the cover 140 and the inflatable enclosure 11. This inflatable inner sole is formed by placing the inflatable enclosure, in an inflated state, onto a support plate with a peripheral surface beneath the enclosure flange 17 and by providing a rim which surrounds the outer edge of the enclosure flange 17 to contain a liquid prepolymer which is poured about the periphery of the enclosure and cured into the elastomer or foam edge. The fabric 148 is coated with an underlayer 142 of elastomer and then placed over the enclosure and bonded to the peripheral edge 136 of elastomer or foam. If desired, a minor amount of a lubricant can be included in the chamber 138 to reduce frictional resistance between the cover 140 and field surface of the enclosure 11. The resultant inner sole 144 has an inflatable enclosure which is inflated under pressure and another air chamber 138 at atmospheric pressure for enhanced comfort. The bulk and weight of the inner sole 144 is minimal.

Figure 12:
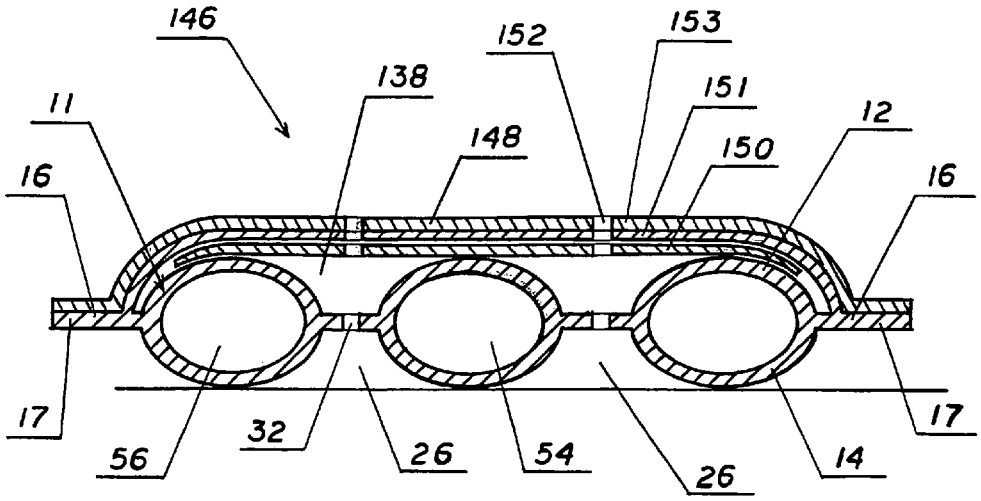
FIG. 12 is an enlarged cross sectional view of a second alternative coating.
Figure 13:
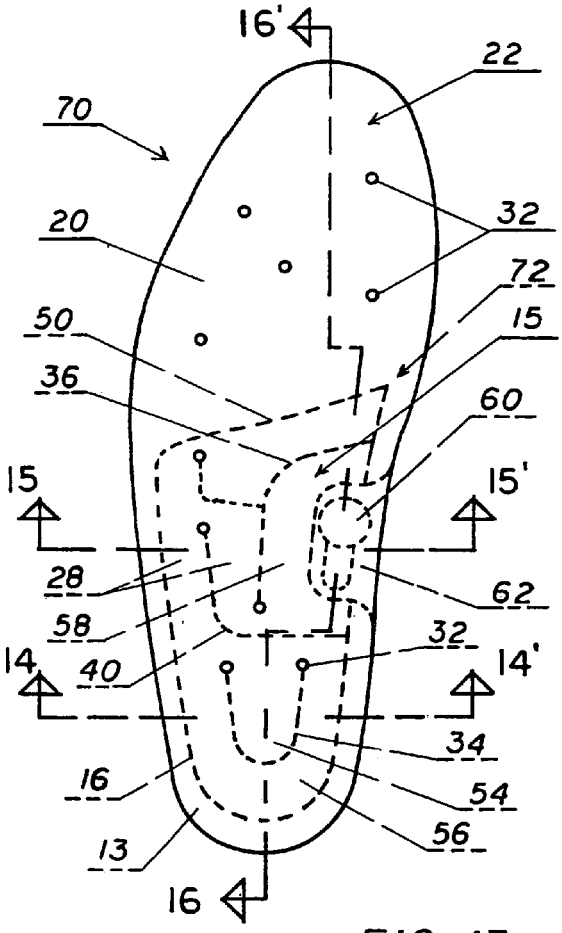
FIG. 13 is a plan view of an alternative inner sole which has an inflated enclosure over the heel and arch areas of the sole and is encapsulated in an elastomeric material with an on-board air pump and adjustable relief valve.
Figure 16:
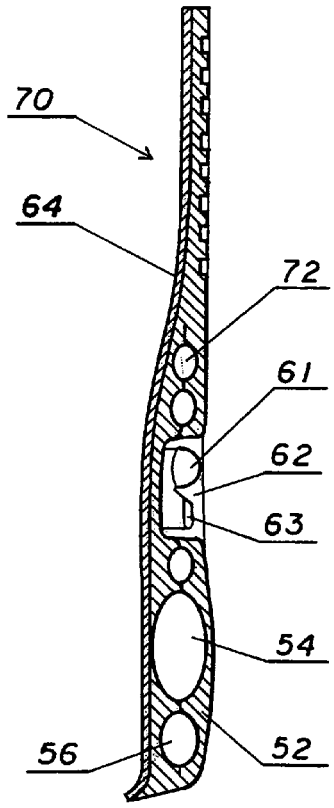
FIG. 16 is a cross sectional view along line 16–16' of the inner sole of FIG. 13.
Figure 15:
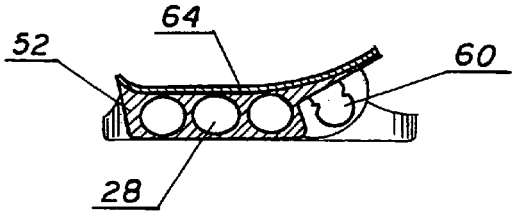
FIG. 15 is a cross sectional view along line 15–15' of the inner sole of FIG. 13.
Figure 14:
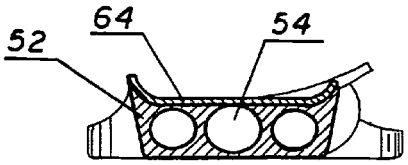
FIG. 14 is a cross sectional view along line 14–14' of the inner sole of FIG. 13.
Figure 17:
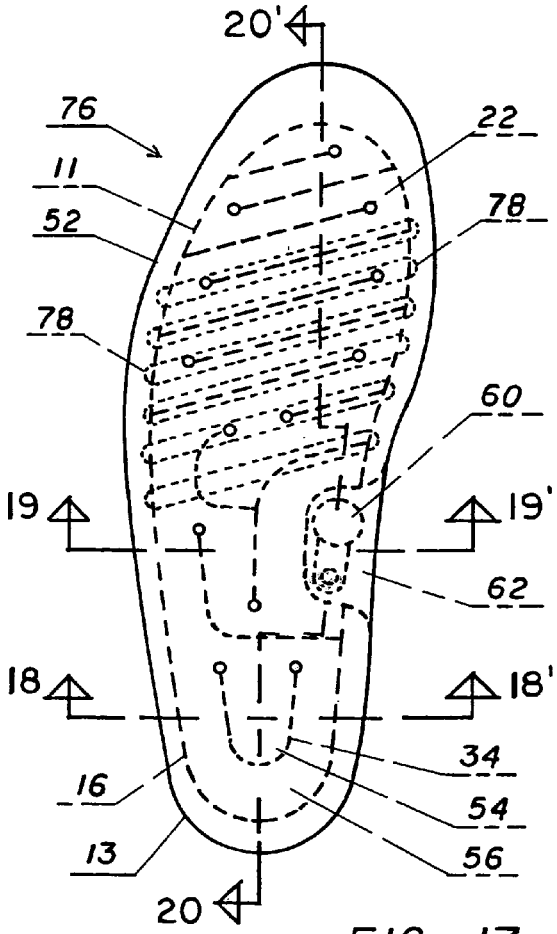
FIGS. 17–20 are plan and sectional views of an alternative inflatable inner sole with embedded magnets.
Figure 20:
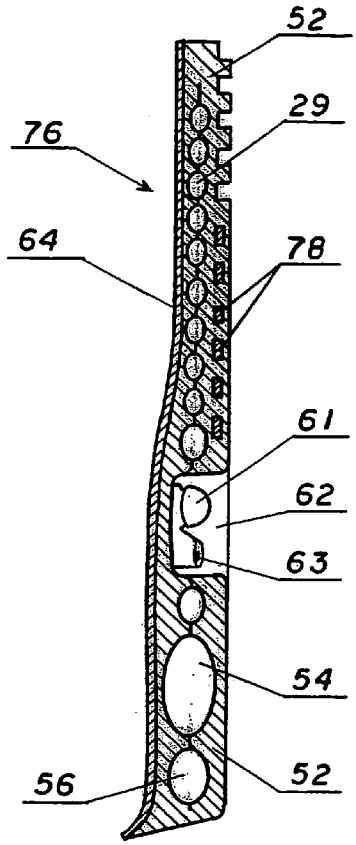
Figure 19:
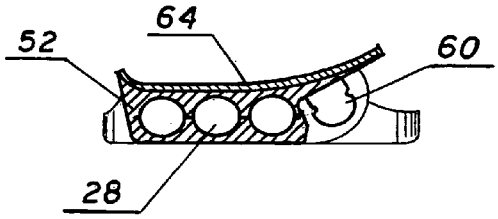
Figure 18:
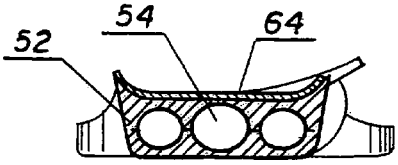
Figure 22:
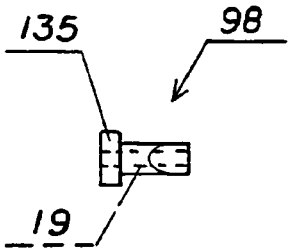
FIG. 22 is a view of a check valve used in the air pump and check valve assembly.
Figure 23:
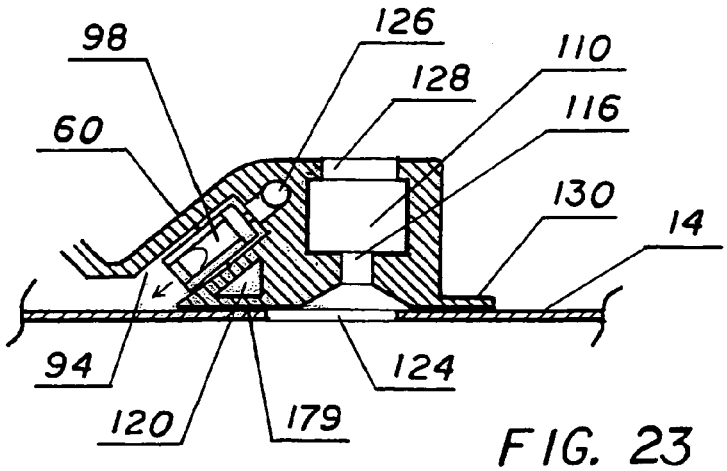
FIG. 23 is a sectional view along line 23–23' of FIG. 21, with the relief valve omitted.
Figure 21:
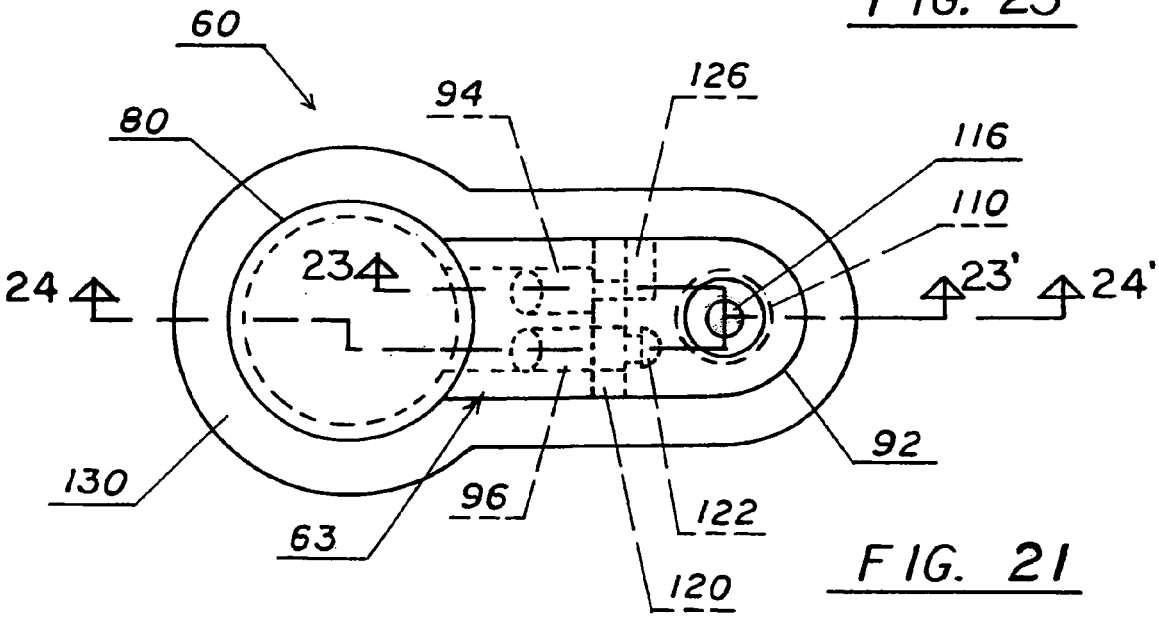
FIG. 21 is a plan view the air pump and check valve assembly used with the inflatable linings.
Figure 24:
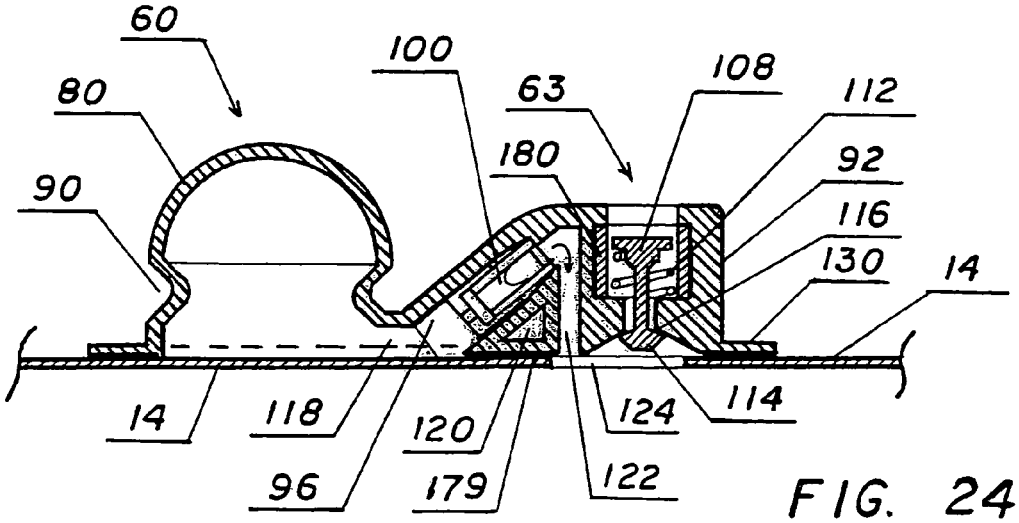
FIG. 24 is a sectional view along line 24–24' of FIG. 21.

FIG. 12 illustrates a cross sectional view of another alternative inner sole 146 which also permits relative movement between an upper cover 153 and the inflatable enclosure 11. In this embodiment, an overlay 150 of Teflon, or of synthetic or natural-rubber or other thermoplastic, in solid or foamed state, is placed over the inflatable enclosure 11. In this illustration the overlay 150 does not extend to the peripheral edge 17 of the enclosure and is not bonded to the enclosure, although it could extend and be bonded to the peripheral edge 17. The cover 153, which comprises a laminate of fabric 148 bonded to an underlayer 151 of a thermoplastic such as polyurethane, is placed over the inflatable enclosure 11 and overlay 150 and is heat sealed to the peripheral flange 17 of the inflatable enclosure 11. As with the inner sole 144 illustrated in FIG. 11, this inner sole 146 also has an air chamber 138. If desired, the inflated enclosure can be provided with apertures 32 to permit air movement between the open channels 26 beneath the inflatable enclosure 11 and the air chamber 138. Also, air circulation through the footwear can be achieved by providing apertures 152 through the overlay 150 and cover 153. These apertures can be formed by die cutting through the cover during finishing operations.

Referring now to FIGS. 13–16, another embodiment of the invention is illustrated in which the inflatable enclosure 72 of the inner sole 70 extends over the heel area 13 and instep area 15 of the inner sole, but does not extend over the metatarsal area 20 or the toe area 22. Flexibility of the inflated inner sole 70 is achieved with the transverse portion 50 of the peripheral seam 16. In this embodiment, comfort and support of the toe and metatarsal areas is provided by the compressibility of the elastomeric matrix, which can be of natural or synthetic rubber in solid or foam texture or of other compressible foams, e.g., polyethylene foam.

FIGS. 17 through 20 are plan and sectional views of an alternative inflatable inner sole 76, which is similar with inner sole 10 described in FIGS. 1–6. The only addition in this embodiment are thin plastic magnetic plates 78 which are encapsulated inside the elastomeric matrix 52 beneath inflatable enclosure 11. These plates are provided in accordance with current popular opinion to enhance blood flow to areas adjacent the magnets, combating fatigue and weakness. The thin plastic magnetic plates 78 are flexible and are strategically positioned beneath the transverse seams 74 of the inflatable enclosure 11 to allow normal flexing and bending of the inner sole 10.

Figure 25:
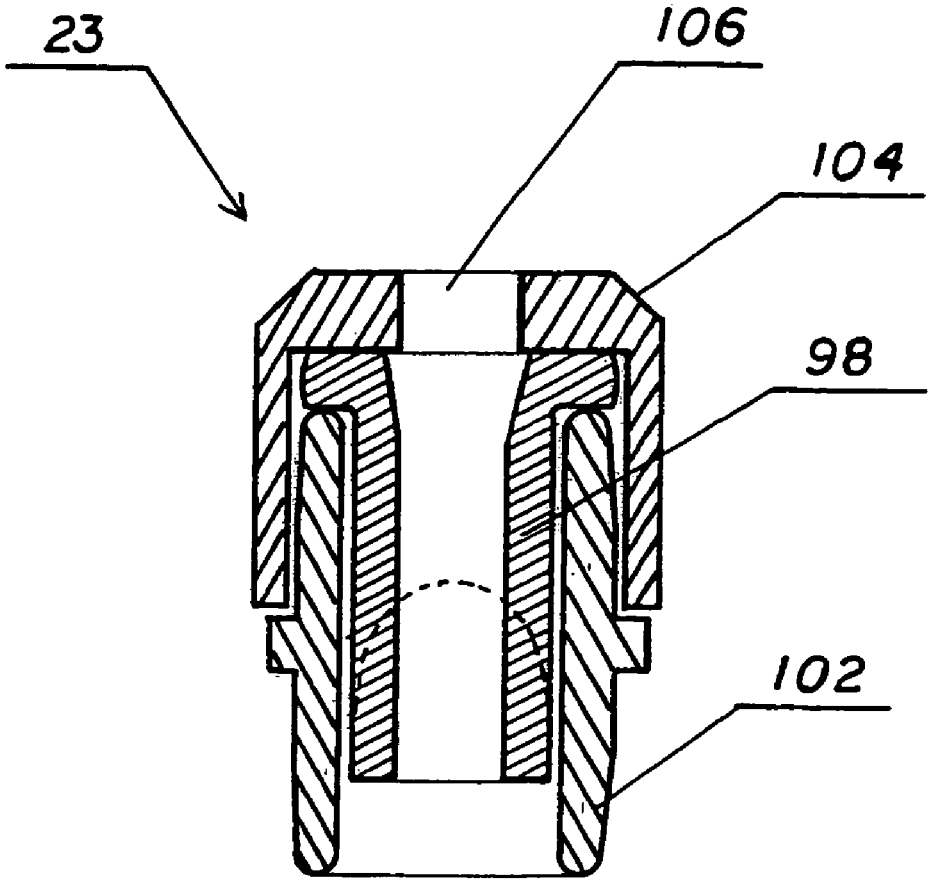
FIG. 25 is a view of an alternative check valve useful in the air pump and relief valve assembly.
Figure 26:
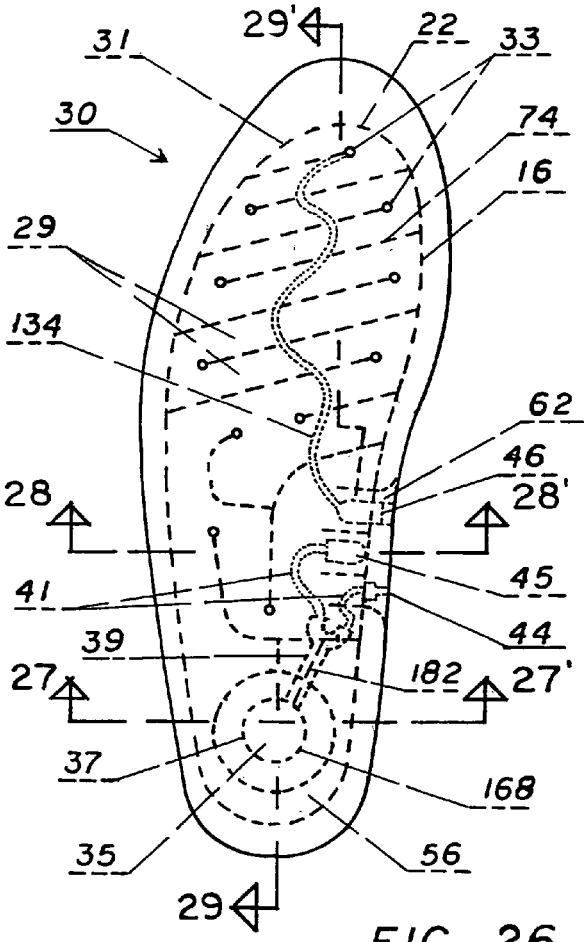
FIG. 26 is a plan view of an alternative inflatable inner sole with an on board air pump in the heel of the inner sole and with an adjustable relief valve.
Figure 29:
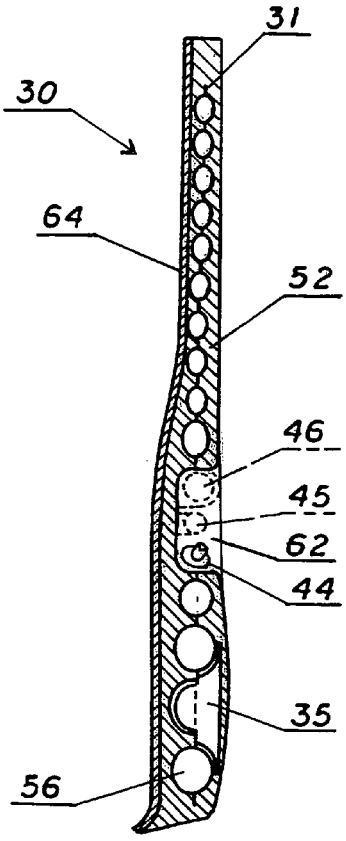
FIG. 29 is a cross sectional view along line 29–29' of the inner sole of FIG. 26.
Figure 28:
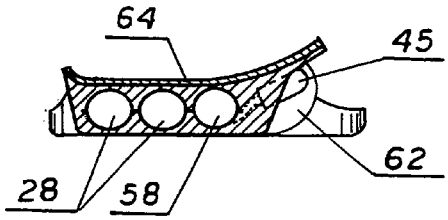
FIG. 28 is a cross sectional view along line 28–28' of the inner sole of FIG. 26.
Figure 27:
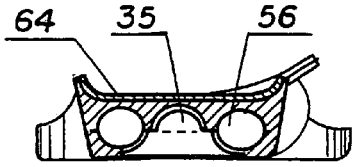
FIG. 27 is a cross sectional view along line 27–27' of the inner sole of FIG. 26.
Figure 30:
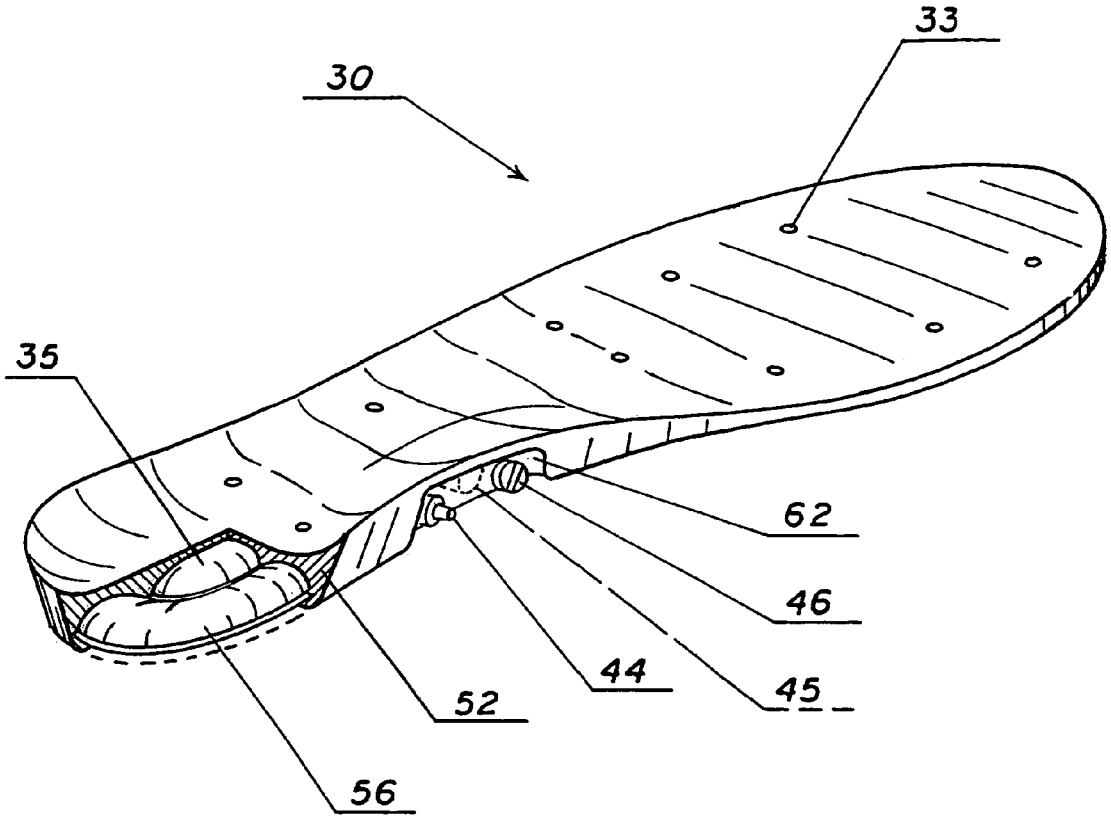
FIG. 30 is a perspective view of the inflatable inner sole of FIG. 26.
Figure 39:
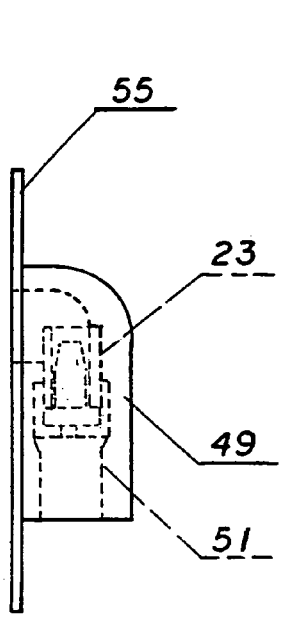
FIGS. 37–40 are views of the check valve assembly used in the inner sole of FIG. 26.
Figure 37:
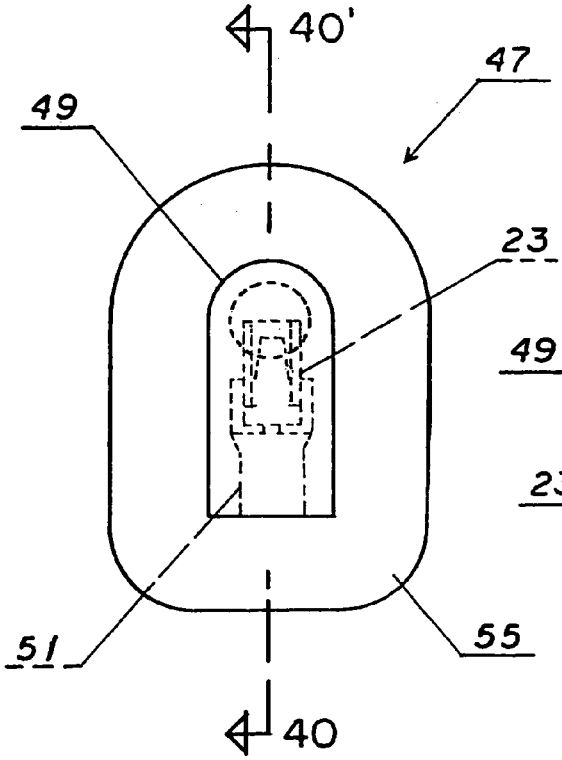
Figure 40:
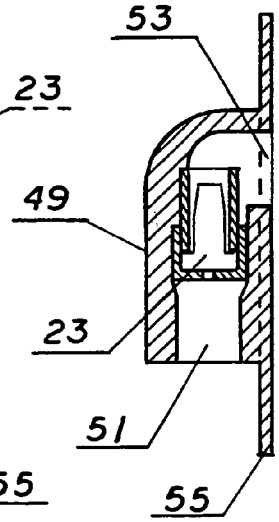
Figure 38:
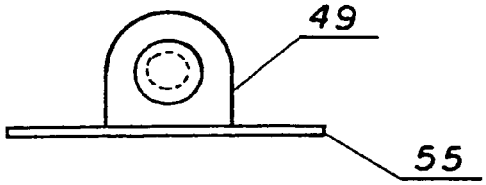
Figure 43:
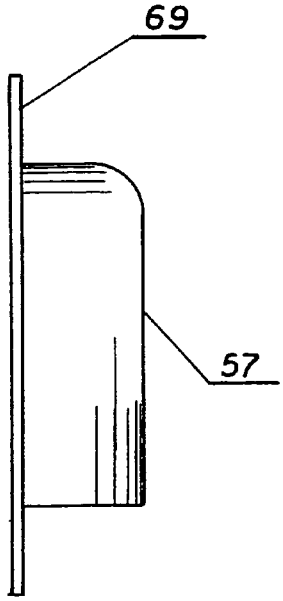
FIGS. 41–44 are views of the pressure control valve used in the inner sole of FIG. 26.
Figure 41:
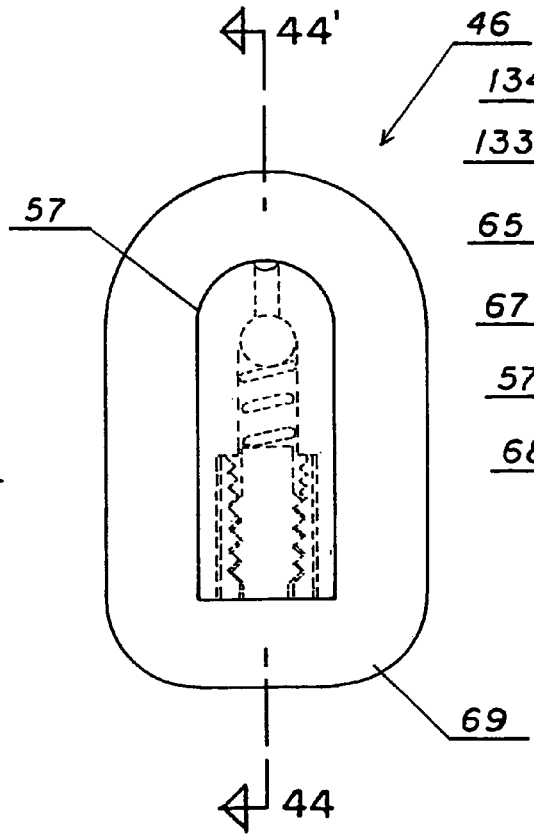
Figure 44:
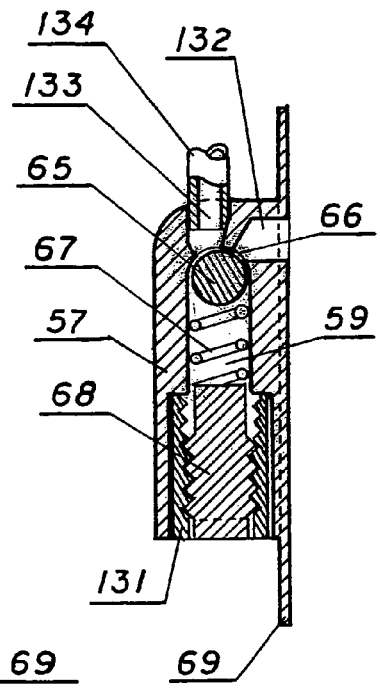

FIGS. 21 through 24 are plan and sectional views of the pump and relief valve assembly 60 which permits the wearer to adjust the inflation pressure within the inflatable enclosure 11 to any desired comfort level or support. The construction and operation of this assembly is described in my prior patent (U.S. Pat. No. 5,846,063). The assembly 60 includes a compressible pump dome 80 which has an undercut 90 for ease of depression. The housing 92 of the assembly 60 and has two cavities 94 and 96 which receive two duck-bill check valves (also shown in FIG. 20); inlet check valve 98 and outlet (discharge) check valve 100. An enlarged cross-sectional view of a subassembly 23 of the check valves is shown in FIG. 25. Prior to insertion into the housing cavities 94 and 96, each of the duck-bill check valves 98 and 100 are inserted into a protective brass sleeve 102 and brass cup 104 which has an opening 106 for air passage. Each valve is captured in the assembly with its flange 135 locked between the sleeve 103 and cup 104. The assembly is then inserted into cavities 94 and 96 of the pump housing 92 illustrated in FIGS. 21, 22 and 24. As the housing 92 is formed of soft plastic, the protective sleeves 102 and cups 104 prevent accidental squeezing of the check valves when forces are applied to the housing 92.

A relief valve operator 108 is inserted into a valve cavity 110 of the relief valve housing 92 and a coil spring 112 is positioned beneath the operator 108 to provide a biased force which seats the seal ball 114 on the lower end of the relief valve operator 108 to seat against the valve aperture 116. There is a passageway 118, which connects the cavity beneath dome 80 and check valve assembly 27. The outlet passage from check valve 100 extends over tunnel 120, through passageway 122 and through opening 124 on the first flexible plastic sheet 12 into the inflatable enclosure. The tunnel 120 accepts a mandrel (metal bar) which is a removable part of the metal sealing die to heat seal the area 179, beneath tunnel 120, to seal the entire periphery of the cavity beneath the dome 80, thereby providing air circulation only through the check valves 98 and 100. The inlet check valve 98 receives air through side opening 126 and discharges into the cavity beneath pump dome 80. There is a recess 128 on top surface of the relief valve housing 92 to prevent from accidental activation of the relief valve operator 108 when in contact with existing shoe lining. An aluminum sleeve 180 is inserted inside cavity 110 to reinforce housing 92 to prevent accidental squeezing and activation of the relief valve.

There is a flange 130 around the assembly 60 to permit permanent attachment of the assembly to a supporting surface, usually a plastic sheet by heat sealing or any other alternative process.

Referring now to FIGS. 26–30, the invention is illustrated as an inflatable inner sole 30 which has an air pump 35 located beneath the wearer's heel so that normal walking and running activities will provide inflation pressure to the inflatable enclosure. The heel portion of the inflatable enclosure has a circular opening 37 which is surrounded by a continuous seam 168 to receive the heel air pump 35. The air pump 35 comprises a generally flat, flexible, resilient bulb that is integrally connected to a flexible passageway 39, located underneath seam 182, which extends to the arch area. The passageway 39 is connected with flexible tubes 41, which provides air to the pump through its inlet check valve 44, and to a second flexible, discharge tube 41 which discharges air from the pump 35 into enclosure 31 through check valve 45. The check valves 44 and 45 can be placed in the tubes 41. The inflation enclosure 31 also has a pressure control valve 46 which is mounted in recess 62 for access to the wearer to permit adjustment of the internal pressure, or firmness of the inner sole as desired by the wearer. As described hereinafter, the excess air released by the pressure control valve passes through tube 134 which is connected to one or more of the apertures 33 preferably located in the toe area of the inner sole 30 to ventilate the footwear during walking or running activities. During fabrication of the inner sole 30, the flexible tubes, pump 35, discharge check valve 47 and pressure control valve 46 will be secured permanently by the surrounding matrix 52.

FIGS. 31–34 are plan and sectional views of a heel air pump 35 which is formed with an upper part 156 which has the shape and form of the cavity formed underneath the heel area of the inflatable enclosure 31 by seams 168 and 182, and a lower flat part 158 which are sealed with a peripheral seam 160. The pump 35 has an integral passageway 39 which has two ports; inlet port 162 and discharge port 164. It can be made from polyurethane, kraton, silicon, rubber, etc., any material that is soft, has good resiliency, good memory and is durable. There is a slot 166 on the upper part of the pump to accept circular seam 168 of the inflatable enclosure 31. This pump can be assembled by heat sealing or a permanently glued seam.

FIGS. 35 and 36 are sectional views of alternative air pumps 172 and 174. The air pump 172 shown in FIG. 35 has a dome 176 which is received within the circular seam 168 and which can be heat sealed to the seam. The air pump 174 shown in FIG. 36 is a flat circular chamber 178 which is received in the circular area beneath the inflatable enclosure 170.

FIGS. 37–40 are views of the discharge check valve assembly 47. There is a duck bill check valve 23 mounted in the housing 49. The inlet port 51 and outlet port 53 align with openings (not shown) of the lower sheet of the inflatable enclosure and the housing has a flange 55 for permanent attachment of the assembly to the enclosure by heat sealing or other bonding techniques.

Figure 42:
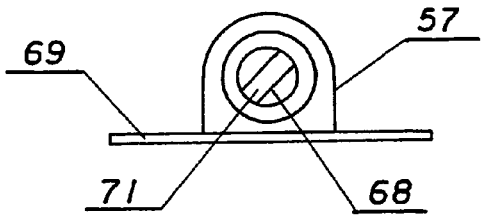
Figure 45:
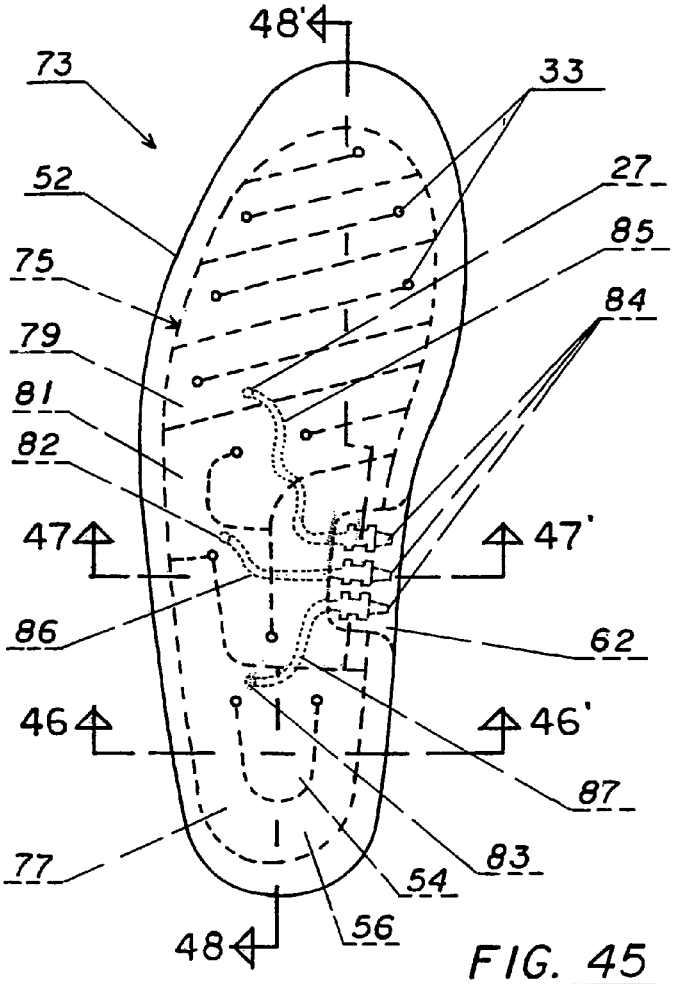
FIG. 45 is a plan view of an alternative inflatable inner sole without an on-board air pump.
Figure 48:
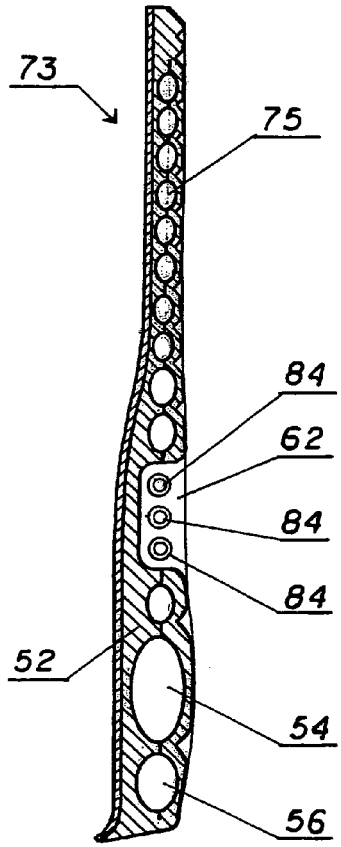
FIG. 48 is a cross sectional view along line 48–48' of the inner sole of FIG. 45.
Figure 47:
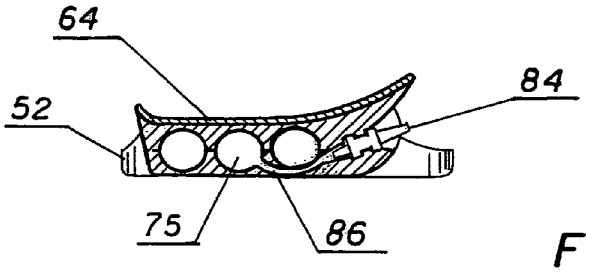
FIG. 47 is a cross sectional view along line 47–47' of the inner sole of FIG. 45.
Figure 46:
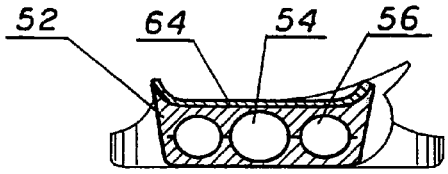
FIG. 46 is a cross sectional view along line 46–46' of the inner sole of FIG. 45.

FIGS. 41–44 illustrate the automatic adjustable relief valve assembly 46 which has a housing 57 having intersecting passageways 59, 132 and 133. The large diameter passageway 59 receives a ball valve member 65 which is biased against the spherically concave terminus 66 of the passageway 59 by a spring 67. Tension on the spring 67 is adjustable by advance or retraction of the spring retainer 68 in its threaded engagement in sleeve 131 which is permanently seated in passageway 59. The inlet passageway 132 communicates with the enclosure 31 and the outlet passageway 133 discharges beneath the enclosure 31 through tube 134 discharging air through the apertures 32 and 33 of the inner sole 30. This establishes a forced air circulation in the shoe. The housing 57 has a peripheral flange 69 which is permanently bonded to the lower sheet of the enclosure 31. As shown in FIG. 42, the spring retainer 68 has an end slot 71 to receive a tool blade, permitting the wearer to advance or retract its position in passageway 59.

Figure 50:
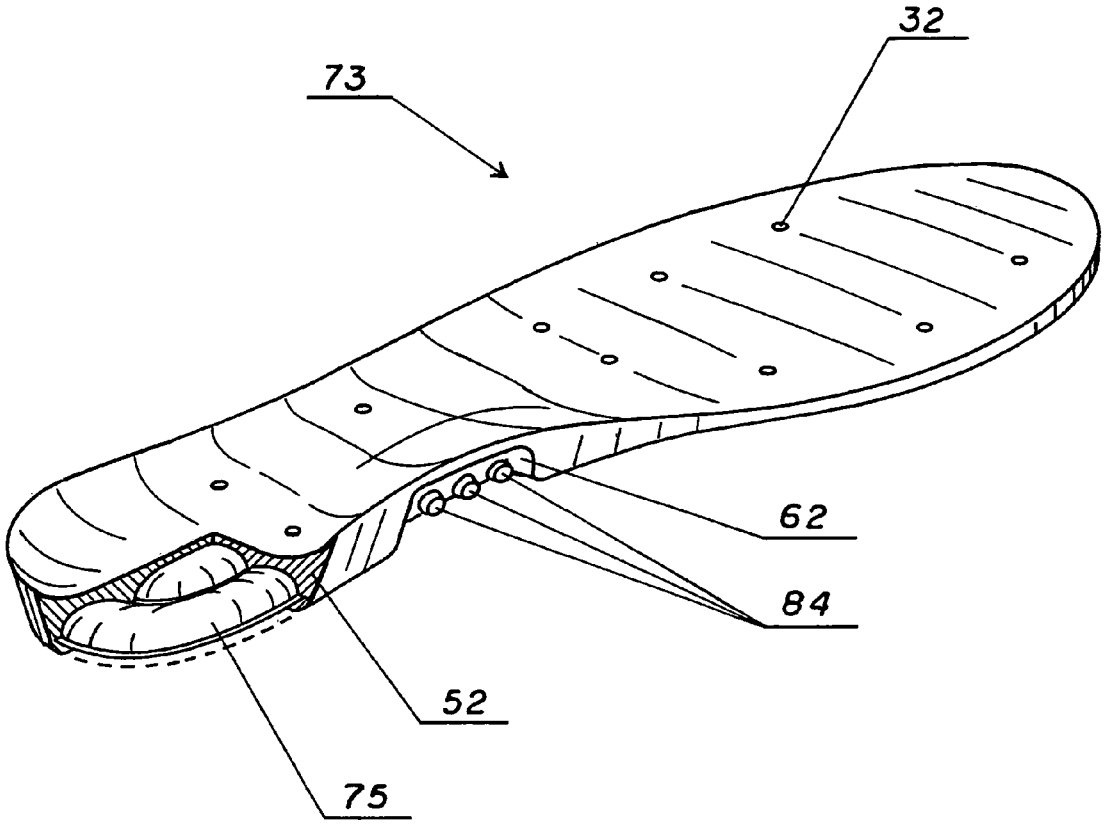
FIG. 50 is a perspective, partial sectional view of the inflatable inner sole shown in FIGS. 45–48.

FIGS. 45–48 are planar and sectional views of an alternative inflatable inner sole 73, which has an inflatable enclosure 75 that is divided into three independent chambers 77, 79 and 81, which are located at the front (toe and metatarsal), arch and heel areas of the inner sole 73. These chambers have apertures 27, 82 and 83, each of which communicates with a respective connector assembly 84. The connector assemblies are located in recess 62 and are connected to the inflatable chambers by flexible tubes 85, 86 and 87 which are bonded to the apertures 27, 82 and 83. The location of the connector assemblies is best shown in FIG. 50 which is a perspective and sectional view of the inflatable inner sole 73. This embodiment uses an external source of inflation gas, e.g., compressed air or other gas such as carbon dioxide which is attached to the connector assemblies 84.

Figure 49:
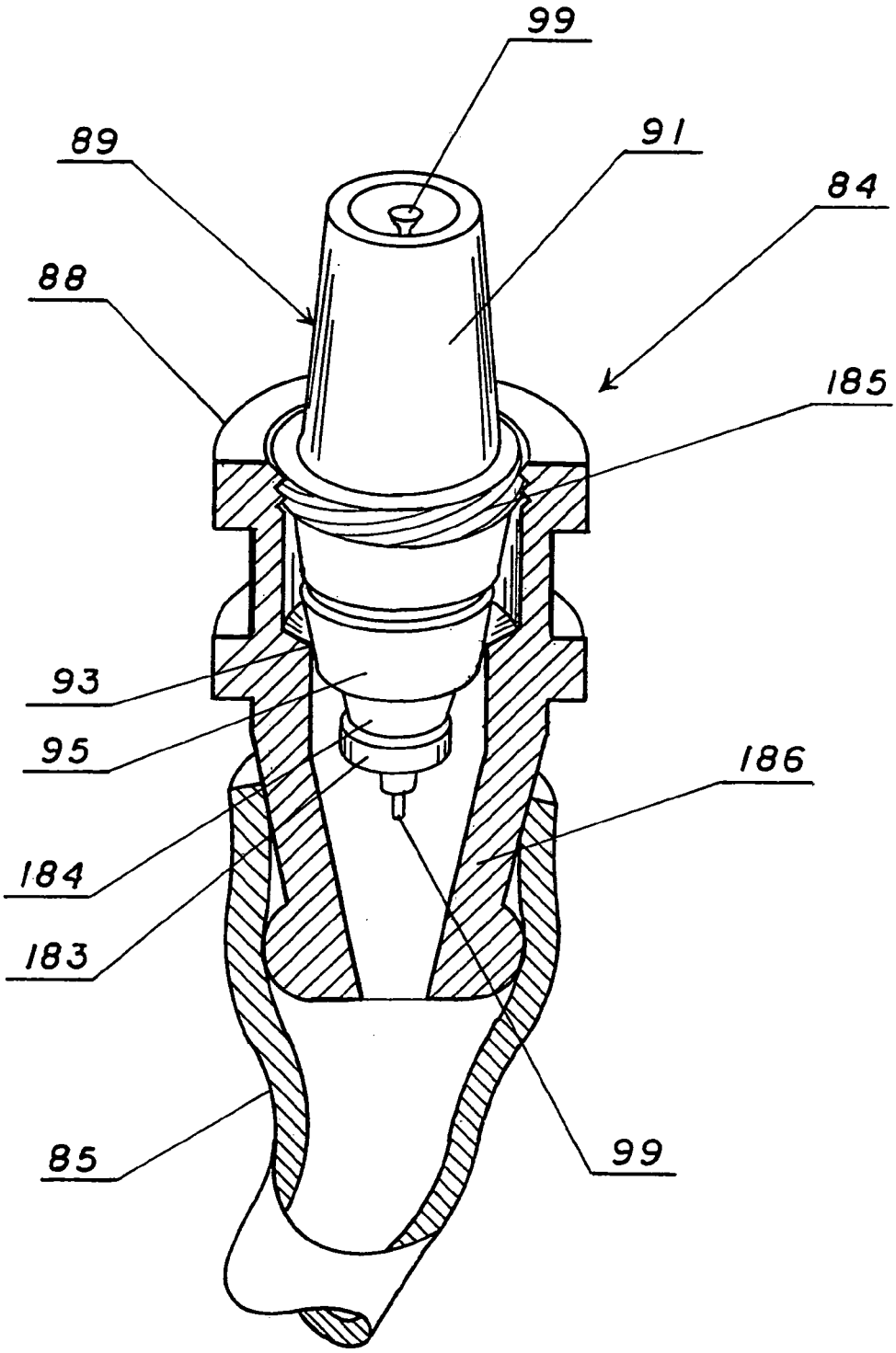
FIG. 49 is a sectional view of the relief valve and connector to attach an external source of pressured gas to the inner sole of FIG. 45.

FIG. 49 is a sectional view of the connector/valve assembly 84. The connector/valve assembly 84 is conventional inflation valve similar to valves available from Schrader Automotive Inc., Nashville, Tenn. 37202. A valve 89 having a valve member 183 is resiliently biased into a closed position against valve seat 184 by an internal spring (not shown). A valve member 183 is secured to a rod 99 which extends through the valve 89 to an upper end 99 which serves as a valve operator to permit opening of the valve. The valve 89 has external threads which are threadably received within a connector housing 88. The upper end of a neck 91 of the valve 89 is conical to permit removable attachment of tubing. The lower end of valve 89 has a rubber ring 95 which seats against an internal shoulder 93 of the housing 88 for resiliently sealing within the connector housing. The connector housing has a conical connector leg 186 to receive a tubing such as tube 85.

Figure 51:
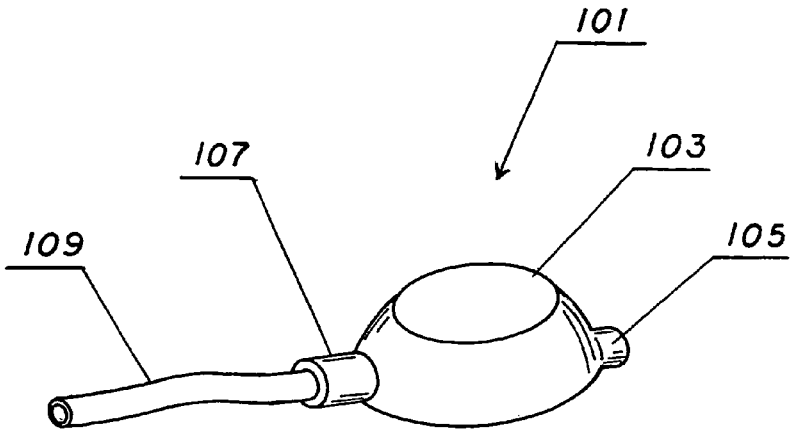
FIG. 51 illustrates an external air pump useful with the inflatable inner sole shown in FIGS. 45–48.

FIG. 51 is a perspective view of an external hand pump 101. It has a flexible bulb 103, inlet check valve 105, outlet check valve 107 and flexible tube 109 which can be connected to the connector assemblies 84.

Figures 52, 53, 54:
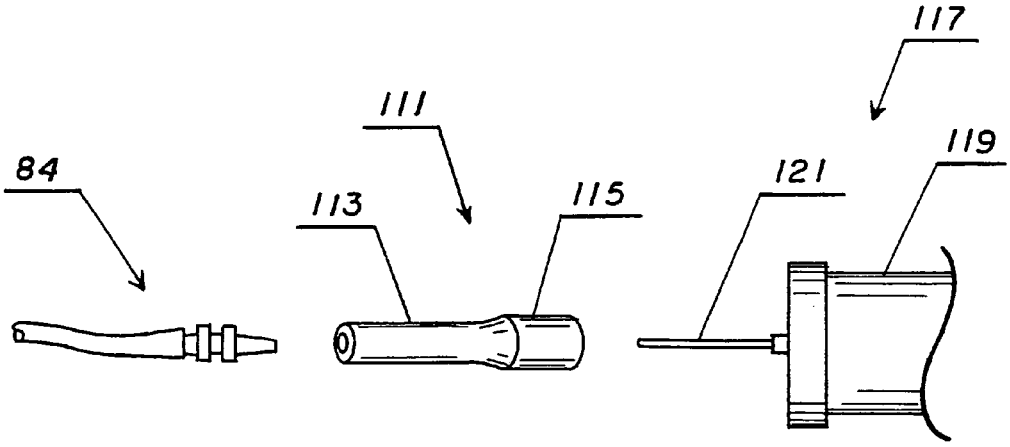
FIGS. 52–54 are views of an adapter, a connector, and a needle valve air source useful with the inflatable inner sole of FIGS. 45–48.

FIG. 52 is a perspective view of an adapter 111 which enables inflation of the inner sole in absence of the hand pump. It has flexible tube 113 which contains a rubber needle valve 115 similar to the needle valves used in basketballs, footballs, soccer balls, volleyballs, to permit use of a needle air pump 117 having a pump cylinder 119 with an air discharge needle 121, as shown in FIG. 54. Alternatively other air sources such as pressured cylinders of air, nitrogen or carbon dioxide could be substituted for the air pump.

Figure 55:
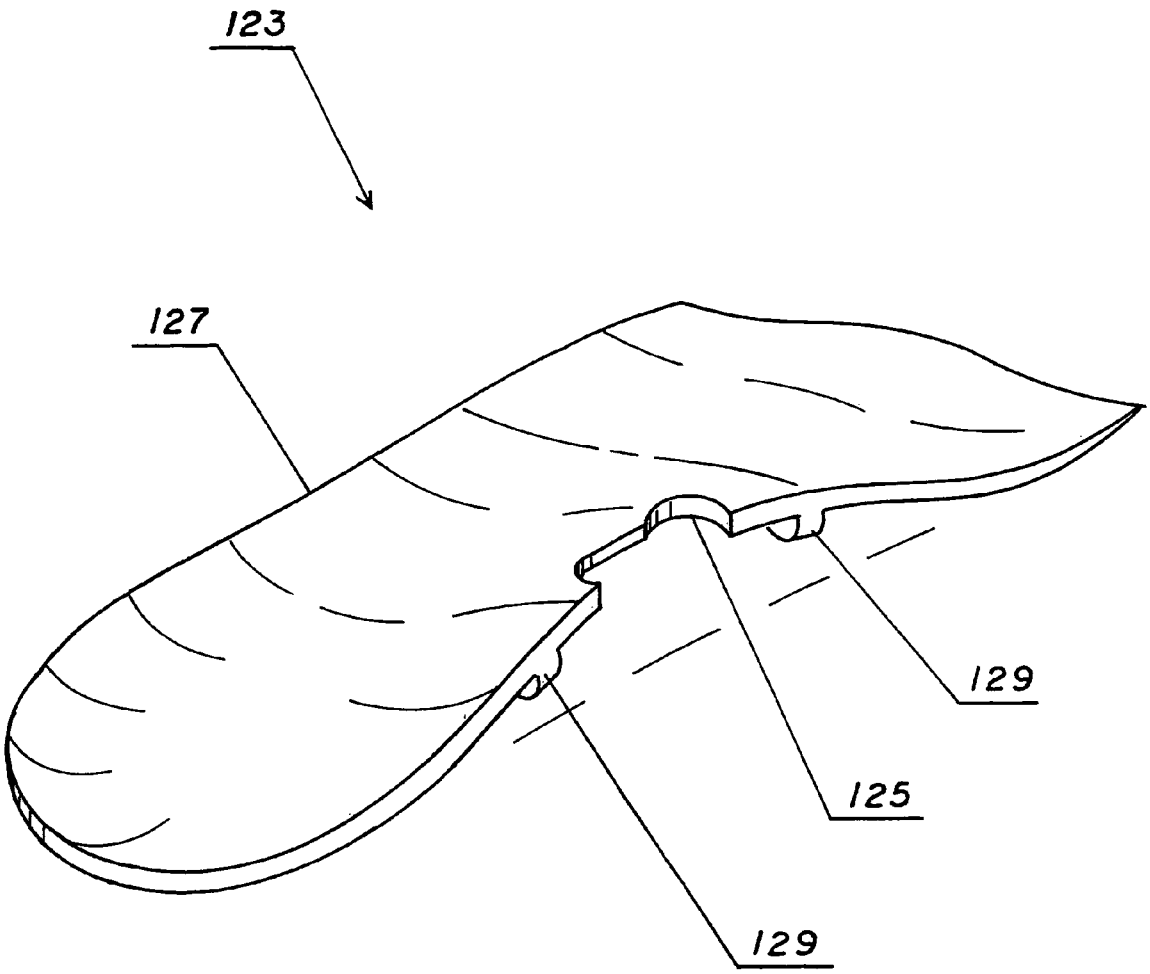
FIG. 55 is a perspective view of an orthopedic insert for use with the inflatable inner soles of the invention.

FIG. 55 is a perspective view of an orthopedic layer 123 which has a recess 125 to receive the air pump 61 described and illustrated with regard to FIGS. 31 through 36. In this application, the orthopedic layer 123 is placed beneath or above the inflatable inner sole 10 of FIG. 1. Orthopedic inserts such as layer 123 are usually custom made inserts worn in shoes to support the foot, especially for sports. The layer 123 is a plastic plate 127 with a shape and form to provide arch support. The plate 127 has plastic ribs 129 around recess 125.

The invention has been described with reference to the illustrated and presently preferred embodiment. It is not intended that the invention be unduly limited by this disclosure of the preferred embodiment but instead by the elements and their equivalents set forth in the following claims.

What is claimed is:

1. An inflatable inner sole for footwear which comprises:

a. an inflatable enclosure formed of first and second sheets of plastic film bonded together in a continuous seam defining a peripheral flange surrounding a surface field and forming a sealed interior with a plurality of discontinuous seams extending across said field to form interconnecting, internal passageways within the sealed interior, wherein the continuous seam and the discontinuous seams lie generally in a plane;

b. a layer of flexible plastic overlying and bonded to said inflatable enclosure;

c. a flexible cover sheet overlying and bonded to the upper surface of said flexible plastic;

d. an inflation system comprising an inlet port and an outlet port communicating with said sealed interior, and a pressure control valve having a valve inlet, valve operator and valve outlet with its inlet communicating with said outlet port; and e. wherein a medial recess is formed by portions of the first and second sheets, a base of the medial recess extending out of the plane, and at least a portion of the inflation system is received in the medial recess.

2. The inflatable inner sole of claim 1 wherein said plastic is natural or synthetic rubber.

3. The inflatable inner sole of claim 1 wherein said plastic is a flexible synthetic thermoplastic.

4. The inflatable inner sole of claim 1 including discontinuous seams in the arch area of said inner sole which form the medial recess in said inner sole.

5. The inflatable inner sole of claim 4, the inflation system further including an air pump mounted in said medial recess and comprising a flexible bulb, the pump including the valve inlet port having an inlet check valve and the valve outlet port having an outlet check valve.

6. The inflatable inner sole of claim 5 including an air pump housing located in said recess with said check valves mounted in said housing and also including a normally closed pressure relief valve having the valve operator accessible in said recess to release air from said sealed enclosure.

7. The inflatable inner sole of claim 1 wherein said layer surrounds said inflatable enclosure.

8. The inflatable inner sole of claim 7 wherein:

the inflation system further comprises an air pump;

said inflatable enclosure has a through opening surrounded by a continuous seam joining the air pump with the inflatable enclosure;

the air pump comprises said outlet port and said inlet port of said sealed enclosure.

9. The inflatable inner sole of claim 8 including a supply tube extending from a flexible bulb to said air pump inlet and outlet ports.

10. The inflatable inner sole of claim 9 including discontinuous seams in the arch area of said inner sole which form a medial recess with said check valves located in said recess and said supply tube extending between said flexible bulb and said recess.

11. The inflatable inner sole of claim 10 wherein said pressure control valve is also located in said recess and including a flexible tube connecting the valve outlet port to at least one of a plurality of apertures through said cover sheet.

12. The inflatable inner sole of claim 11 wherein said pressure control valve is an automatic pressure relief valve with an internal spring biasing said valve operator into a closed position with adjustment means permitting user adjustment of the tension on said spring.

13. The inflatable inner sole of claim 12 wherein said pressure relief valve is positioned in said recess with the valve operator exposed in said recess for access to a user for adjustment of the pressure setting of said valve.

14. The inflatable inner sole of claim 1 including at least one continuous seam continuously extending across said field of said enclosure to divide said enclosure into at least two independent inflatable chambers.

15. The inflatable inner sole of claim 14 including an air port in each of said chambers, each connected to a tube which communicates with a respective inflation means exteriorly of the inflatable enclosure.

16. The inflatable inner sole of claim 15 including discontinuous seams in the arch area of said inner sole which form a medial recess in said inner sole and wherein each of said respective inflation means are mounted in said recess.

17. The inflatable inner sole of claim 16 wherein each of said inflation means comprises an assembly of a connector for attachment of an external air supply tube and a relief valve.

18. The inflatable inner sole of claim 17 wherein said enclosure has two continuous seams which divide said sealed enclosure into three independent inflatable chambers.

19. The inflatable inner sole of claim 18 wherein an independent inflatable chamber is located at each of the heel, instep and metatarsal areas of said inner sole.

20. The inflatable inner sole of claim 1 wherein said discontinuous seams extend transversely across the metatarsal area of said inner sole and including flexible magnetic plates positioned beneath the transverse seams of the inflatable enclosure.

* * * * *